US005307081A

United States Patent [19]

Harmuth

[11] Patent Number: 5,307,081

[45] Date of Patent: Apr. 26, 1994

[54] RADIATOR FOR SLOWLY VARYING ELECTROMAGNETIC WAVES

[75] Inventor: Henny F. Harmuth, Potomac, Md.

[73] Assignee: Geophysical Survey Systems, Inc., North Salem, N.H.

[21] Appl. No.: 924,368

[22] Filed: Jul. 31, 1992

Related U.S. Application Data

[63] Continuation of Ser. No. 618,715, Nov. 27, 1990, abandoned.

[51] Int. Cl.[5] ..... H01Q 11/040; H01Q 17/000; H01Q 1/040

[52] U.S. Cl. ..... 343/842; 343/788; 343/866; 342/1

[58] Field of Search ..... 343/741-744, 343/753, 787, 788, 834, 866, 867, 898, 912, 913, 756, 841, 842; 1 PC/1/00, 1/48; H01Q 1/52, 11/02, 11/04, 11/12, 11/14, 7/00-7/08, 15/00-15/24, 19/00-19/09

[56] References Cited

U.S. PATENT DOCUMENTS

| | | | |
|---|---|---|---|
| 2,153,589 | 4/1939 | Peterson | 343/732 |
| 2,501,430 | 3/1950 | Alford | 343/741 |
| 3,478,362 | 11/1966 | Ricardi et al. | 343/769 |
| 3,587,107 | 6/1971 | Ross | 343/739 |
| 3,605,097 | 9/1971 | Barkoczy | 343/739 |
| 3,710,258 | 1/1973 | Strenglein | 325/105 |
| 3,806,795 | 4/1974 | Morey | 324/6 |
| 4,506,267 | 3/1985 | Harmuth | 343/744 |
| 4,725,490 | 2/1988 | Goldberg | 343/756 |

OTHER PUBLICATIONS

Proceedings of the IEEE, vol. 62, No. 1, Jan. 1974, pp. 36-44, IEEE, New York, US; L.A. Robinson et al.: "Location and recognition of discontinuities in dielectric media using synthetic RF pulses".

*Primary Examiner*—Rolf Hille
*Assistant Examiner*—Peter T. Brown
*Attorney, Agent, or Firm*—Wolf, Greenfield & Sacks

[57] ABSTRACT

A radiator useful for radiating pulses with a duration of about 10 ms is disclosed. Such pulses occupy the frequency band from zero to a few hundred Hertz. For a given time variation of an electromagnetic signal, the energy radiated in the far field is proportional to $(Is)^2$, where I is the current amplitude in the antenna and s is the length of the radiator. Typical antenna designs cannot be used at very low frequencies with large relative bandwidths. However, the large current radiator disclosed, herein, is small, has antenna currents in the order of $10^8$ A, and requires a drive voltage of about 1 volt and drive current of $10^4$ A. This large current radiator is designed with a small antenna length s by using a design wherein the antenna current is n times larger than the drive current. This is accomplished by winding electrically conductive means n times around a shield so that the n forward loop wires are all on one side of the shield, and cover a surface area sxW. The n return loop wires are on the opposite side of the shield and are confined so that they cover a surface area that is very small compared to the area of the forward loop. Furthermore, the shield is fabricated to reflect the electromagnetic energy produced by the forward loop and absorb the electromagnetic energy produced by the return loop. Hence, the antenna is highly efficient. And, since n can be 10,000 or more, the antenna current can be in the kilo Ampere range and beyond with a moderate drive current.

24 Claims, 6 Drawing Sheets

RADIATOR FOR SLOWLY VARYING ELECTROMAGNETIC WAVES

This application is a continuation of application Ser. No. 07/618,715 filed Nov. 27, 1990, now abandoned.

FIELD OF THE INVENTION

This to a small antenna for radiating low frequency, large relative bandwidth electromagnetic waves.

BACKGROUND OF THE INVENTION

Very slowly varying electromagnetic waves can penetrate not just air, but also earth and water. This is true despite the large conductivity of earth and water (e.g., the conductivity of sea water is about 4 A/Vm). Hence, electronic communication can be achieved through earth and water as well as through air. For instance, it is known that underwater communication to depths of 500 m can be achieved with sinusoidal waves of 50 Hz and less. However, two problems are encountered when communicating with such low frequency sine waves. First, at such low frequencies, antennas of one quarter wavelength and other effective designs are very long (i.e., 1 km to 100 km). Hence, they are not very portable and may even be required to be permanently located on large tracts of land. A second problem is that efficient sine wave antennas have small relative bandwidths. With a typical relative bandwidth of 1%, a carrier frequency of 50 Hz will only be useful in transmitting signals with a baseband bandwidth of about 0.5 Hz. Since Nyquist s theorem states that the information rate can not exceed two pulses per cycle, a maximum of only one pulse per second can be transmitted (i.e., $2\times0.5$ Hz$=1$ pulse per sec.). Since teletype characters consist of a sequence of five pulses, five seconds are required to transmit one teletype character. Accordingly, one line of 60 characters would require 300 seconds (i.e., five minutes). It is evident that, in the above situation the transmission rate of information is extremely slow. However, the transmission rate can be increased to approximately 50 pulses per second, (i.e., a speedup of 50 times), by using a large relative bandwidth and eliminating the requirement for a sinusoidal carrier. By using pulses with a duration of 20 ms and occupying the entire frequency spectrum from 0 to 50 Hz (i.e., $0<f<50$ Hz) a transmission rate of 50 pulses per second (i.e., 10 teletype characters per second) can be achieved. However, there remains the problem of designing a high current antenna for such slowly varying waves, particularly for mobile use.

U.S. Pat. No. 4,506,267 to H. F. Harmuth describes the antenna that is the predecessor to the present invention, and which is an efficient high current radiator for large relative bandwidth signals. It has a forward loop geometry that is very different from the return loop, and has a high permeability shield around the return loop that absorbs its electromagnetic radiation. That antenna, however, is for pulses with a duration of approximately one nanosecond, and, as described in that patent, is not an effective radiator for pulses on the order of 10 milliseconds. For such relatively long pulses, ferrites cannot be used for separating the forward and the return loops of the radiator, other materials and techniques are needed.

The high current capability of the above mentioned radiator enables us to make an antenna that has a short length. As mentioned above, the long length of effective antennas was always a problem for slowly varying electromagnetic waves. Radiators for slowly varying electromagnetic waves are characterized by the product sI, where s is the length of the radiator and I the peak current flowing through the radiator. This fact allows a trade-off between s and I. That is, one can build physically small radiators by using large antenna currents, or vice versa. But large currents (e.g., hundreds of kiloAmperes) present a problem that has heretofore been a major obstacle.

Accordingly, one object of this invention is to provide a highly efficient antenna for radiating low frequency non sinusoidal electromagnetic energy with wide relative bandwidth.

Another object is to provide such an antenna which can handle large currents.

Another object of this invention is to increase the efficiency of an electromagnetic radiator by introducing a specially designed shield that reflects electromagnetic waves.

A further object of this invention is to arrange the geometry of the radiator and the composition of the shield so that the electromagnetic shield absorbs the electromagnetic waves radiated by return loop current, and reflects the electromagnetic energy from a forward loop, thereby increasing the efficiency of the antenna.

Yet another object of this invention is to provide a material that has low conductivity in the direction of the incident electric field vector and high permeability in the direction of the incident magnetic field vector, which will act as a reflector for electromagnetic energy.

Another object of the invention is to provide an antenna in which the antenna current is n times greater than the drive current, by configuring the current path of the antenna as a series wound transformer with n loops, driven by the drive current.

Another object of this invention is to fabricate an antenna with an antenna current that is so large that the antenna itself can be made small and portable even for very low frequency radiation.

Still a further object of this invention is to make an antenna for low frequency electromagnetic waves that is small enough that it can be portable, for carrying on shipboard, airplane, or automobile.

A further object of this invention is to show how an efficient high current land based radiator of great length can be built up by combining many small high current radiators into a large coordinated system.

SUMMARY OF THE INVENTION

The foregoing and other objects are achieved in an efficient large current radiator for low frequency large relative bandwidth signals by surrounding the return loop with a shield that reflects the radiated electromagnetic wave, and by replacing the single forward loop current carrying element with n wires that are wound in series and cover part or all of a surface of the shield, much like transformer wires would around a core.

The radiator disclosed herein has an improved return loop shield, and a technique is described herein for fabricating such a shield which is useful for low frequency, wide bandwidth electromagnetic signals.

The shield is a laminate of high permeability material that is constructed so that it has near zero electrical conductivity in one direction and high magnetic permeability in a perpendicular direction.

The radiator of this invention also resolves the problem of how to achieve huge radiated currents by designing an antenna that has an antenna current which is n times larger than the drive current, where n can be any value from 2 to 10,000 or more. With n equal to 10,000 or more, a moderate drive current can generate antenna currents in the kilo Ampere range and beyond. Thus the invention disclosed herein also relates to a technique for fabricating a small antenna that has a large sI product.

The enhanced efficiency together with the huge antenna currents that can be achieved in this greatly improved antenna, allow it to be made small and portable even for radiating low frequency electromagnetic energy.

It should be evident to anyone skilled in the art that although much of the discussion of this antenna is directed at using it as a radiator of electromagnetic energy, the same principles also make it an efficient receiving antenna as well.

The invention will be better understood from the detailed description below, which should be read in conjunction with the accompanying drawing.

DETAILED DESCRIPTION OF THE PREFERRED EMBODIMENT

Waves with sinusoidal time variation are usually radiated with resonating antennas. However, this method becomes impractical for wavelengths of more than a few hundred meters.

Figure 1A:
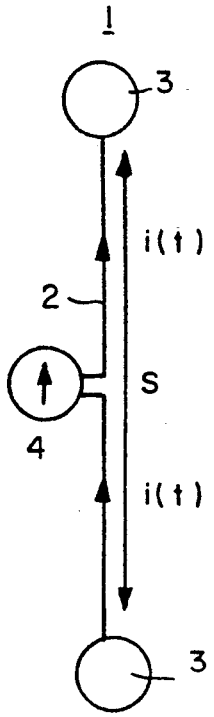
FIG. 1a PRIOR ART
FIG. 1*a* is a schematic diagram of a Hertzian electric dipole.

Consider the Hertzian electric dipole 1 in FIG. 1*a*. It consists of a rod 2 of length s with a sphere 3 at either end, and a current generator 4 in the middle. The spheres act as storage capacitors. This radiator will handle currents i(t)=If(t) with any time variation, and produce electric and magnetic field strengths with the time variation df/dt in the far field. It is evident that it is not a good radiator if one wants large currents, however.

Figure 1B:
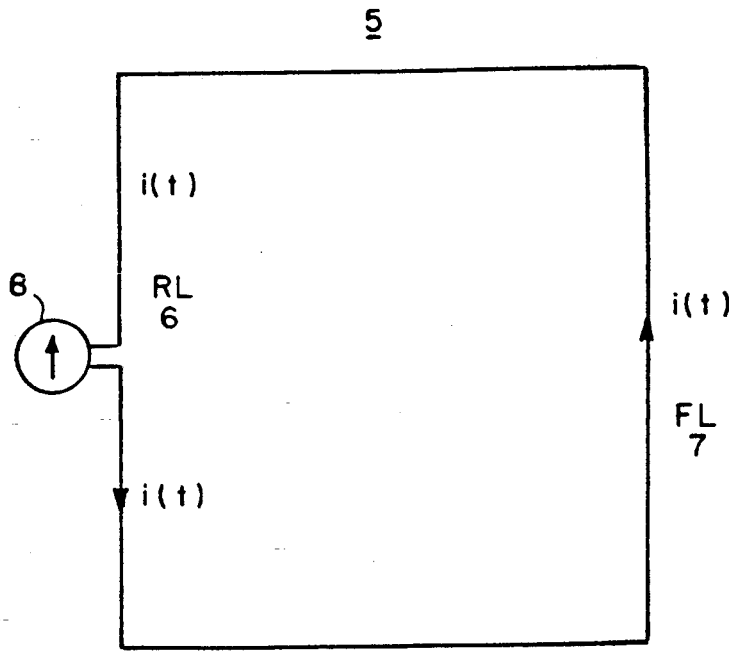
FIG. 1b PRIOR ART
FIG. 1*b* is a schematic diagram of a Hertzian magnetic dipole.

The Hertzian magnetic dipole 5 shown in FIG. 1*b* permits large currents but gives rise to a new problem. The fields produced by the current i(t) in the forward loop 7 are essentially cancelled by the fields produced by the current flowing in the opposite direction in the return loop 6. Two principles can be used to combat this cancellation. First, the forward and return loops can be made geometrically very different. This principle is used in long wave radiators that use a wire for the forward loop and a ground return for the return loop. However, a second principle is required to increase the efficiency of a radiator built according to the first principle.

Figure 2:
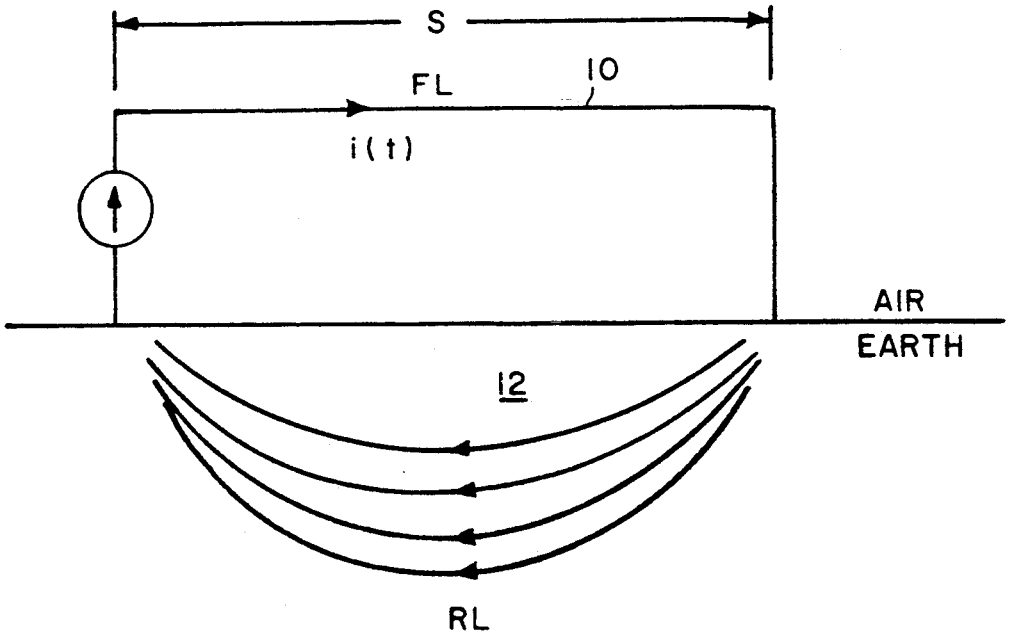
FIG. 2 PRIOR ART
FIG. 2 is a schematic diagram of the current flow in a prior art radiating antenna of length s, for very slowly varying waves, and the return loop through the earth.

A simple radiator of the first principle is the long wire 10 of length s, shown in FIG. 2. The current flows through the forward loop 10, and returns through the Earth 12 which implements the return loop RL. Such a large current antenna is a less efficient radiator than a resonating antenna but it will radiate waves with any slow time variation, not only low frequency sinusoidal waves. U.S. Pat. No. 4,506,267 to H. F. Harmuth describes a more efficient high-current radiator for large relative bandwidth signals. The forward loop covers a large surface area while the return loop is confined so that it covers a comparatively small surface area, and a shield surrounds, and shields the return loop with a material of high permeability that absorbs the electromagnetic energy radiated by the return loop. It is a small size, large current radiator.

Figure 3:
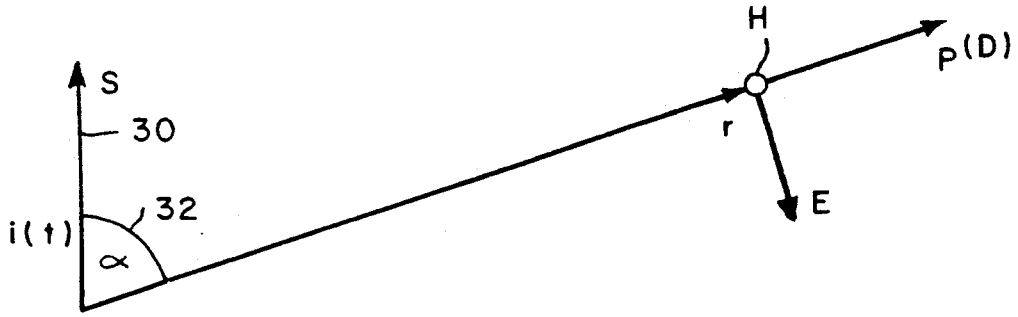
FIG. 3 PRIOR ART
FIG. 3 is a diagram showing the electric (E) and magnetic (H) fields and Poynting vector $P^{(D)}$ at distance r from a radiator represented by the vector s.

To better understand large current radiators, consider first a rod 30 as a vector of length s, and direction s, as shown in FIG. 3. The current i(t)=If(t) flows in it, where I is the amplitude of the current and f(t) its time variation (e.g., i(t)=I cos (ωt)). The electric and magnetic field strengths in the far field are given by the equations on page 47 of *Non-Sinusoidal Waves for Radar and Radio Communication* by H. F. Harmuth, Academic Press, New York, 1981.

The direction of the E field, H field, and $P^{(D)}$ vectors are shown in FIG. 3, (i.e., the notation $P^{(D)}$ represents power density). The magnitudes of these vectors are given by the following equations, which are derived from the above mentioned equations:

$$E = \frac{Z_o \sin \alpha}{4\pi cr} sI \frac{df}{dt} \quad \text{(Eq. 1)}$$

$$H = \frac{\sin \alpha}{4\pi cr} sI \frac{df}{dt} \quad \text{(Eq. 2)}$$

$$P^{(D)} = Z_o \left( \frac{\sin \alpha}{4\pi cr} \right)^2 sI \left( \frac{df}{dt} \right)^2 . \quad \text{(Eq. 3)}$$

where:

$Z_o$ is the impedance of the medium (e.g., 377Ω);

c is the velocity of light in the medium (e.g., $3\times10^8$m/s);

r is the distance from the radiator, at the point of interest; and $\alpha$ is the angle 32 between the antenna vector s and the vector to the point of interest at distance r, as shown in FIG. 3.

Equation 3 indicates that the power radiated by such an antenna is proportional to the square of the product of its length s, and its current amplitude I.

For a fixed antenna installation, according to FIG. 3, it is reasonable to optimize the antenna by making s a length between 1 km and 100 km. However, a movable antenna would be unwieldy unless its length s were a meter or less. If s is small, the only practical way to achieve large radiated power is to make the current amplitude I large, such as 1 kA or greater. Certainly, large currents are a problem if sinusoidal pulses are to be radiated. Equation 3 indicates that they can also be a problem for switched currents. In Eq. 3 note that we have no control over $Z_o$, c, r, and $\alpha$, but we can control the product (sI df/dt). For a rectangular pulse of duration T, $$\frac{df}{dt} = \frac{1}{T}. \quad \text{(Eq. 4)}$$

Hence, for a pulse of duration T=1 ns and df/dt=$10^9$. And a pulse of duration T=10 ms yields df/dt=$10^2$. There is an enormous difference between the df/dt values in these two cases. It is evident that the larger df/dt is, the smaller sI need be. This makes it easy to choose sI for short pulses. But, for long pulses to achieve a large power density, sI must be so large that a severe implementation problem exists.

To determine what kind of sI values are required, Eq. 3 can be solved for sI. If df/dt=1/T is substituted from Eq. 4, and the direction is chosen such that sin $\alpha$=1 we see that:

$$sI = 4\pi crT\sqrt{P^{(D)}/Zo} \quad \text{(Eq. 5)}$$

With c=$3\times10^8$ m/sec; distance r=20 km=$2\times10^4$; pulse duration T=$10^{-2}$ s; power density $P^{(D)}=1.6\times10^{-10}$W/m$^2$; and Zo=377 ohms; we get:

$$\begin{aligned} sI &= 4\pi \times 3 \times 10^8 \times 2 \times 10^4 \times 10^{-2}\sqrt{1.6 \times 10^{-10}/377} \\ &= 4.9 \times 10^5\, Am \end{aligned} \quad \text{(Eq. 6)}$$

This can be satisfied with a radiator with S=490 km and I=1 A, or a radiator with s=1 m and I=490 kA.

Figure 4:
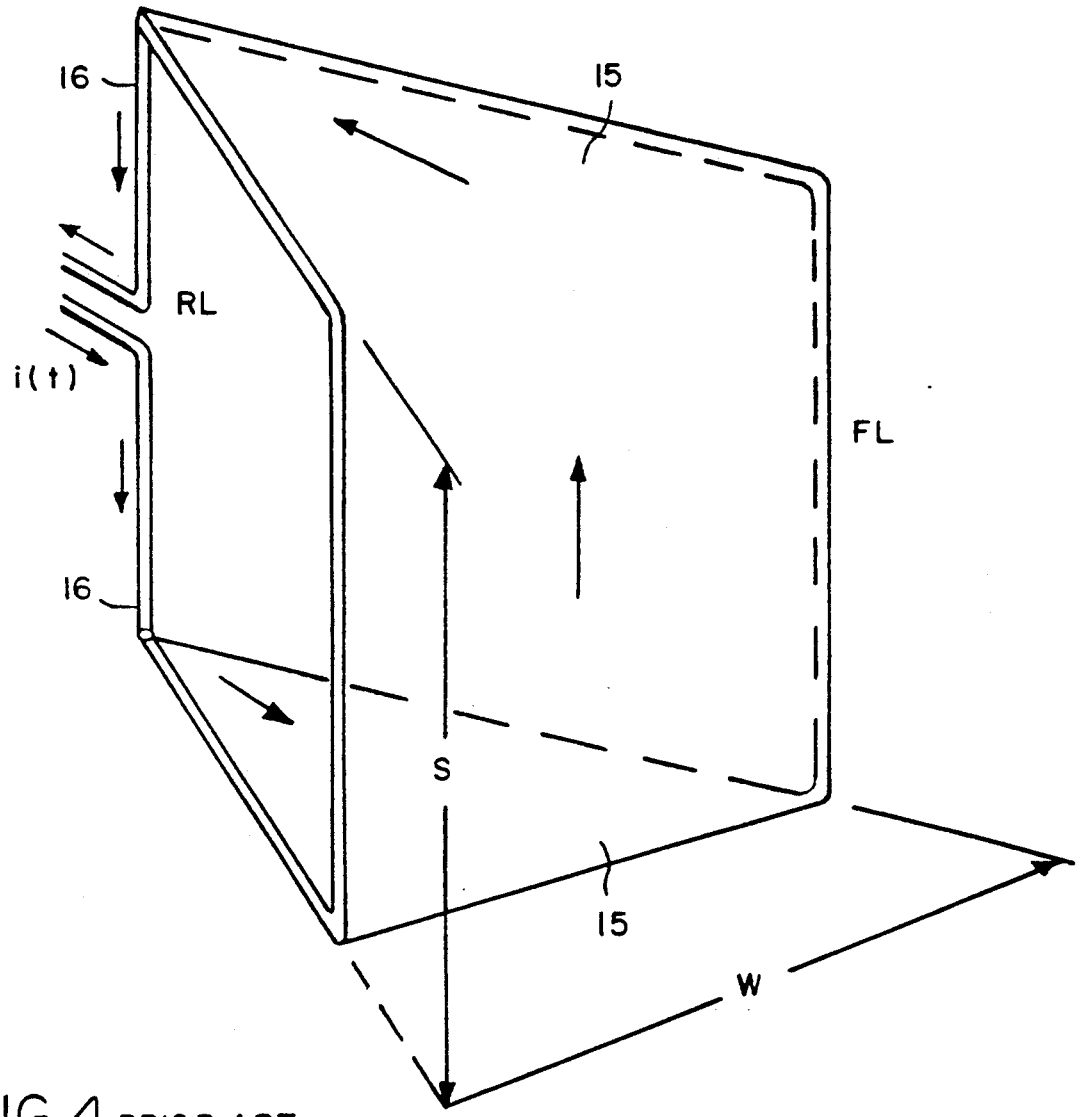
FIG. 4 PRIOR ART
FIG. 4 is a diagrammatic illustration of the prior art radiator of U.S. Pat. No. 4,506,267, which uses a metal plate as forward loop (FL) and a metal rod as return loop (RL)
Figure 5:
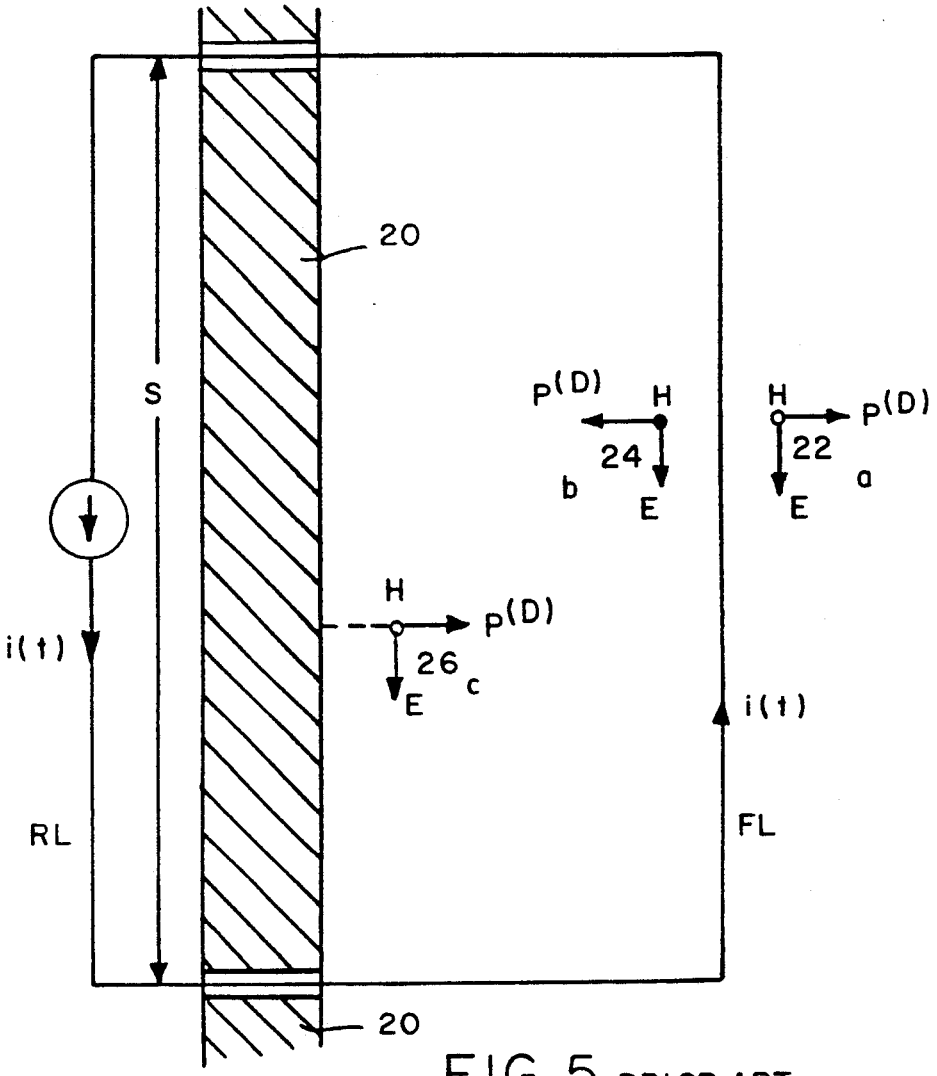
FIG. 5 PRIOR ART
FIG. 5 is a partly diagrammatic, partly schematic circuit diagram showing the prior art use according to U.S. Pat. No. 4,506,267, of a material with very large permeability inserted between the forward loop (FL) and the return loop (RL)

The antenna of FIG. 4 facilitates a high current drive with a forward loop covering a large surface area so that it is a much better radiator than the return loop which covers a small surface area. But a technique for improving the high current radiator of prior art FIG. 4 is indicated in FIG. 5. The forward and return loops of FIG. 4 are shown in a side view. A plate 20 with high permeability and no conductivity is inserted between forward loop FL and return loop RL. The vector diagrams 22 and 24 in FIG. 5 show the direction of the electric and magnetic field strengths E and H, respectively (by convention; an open circle, o, represents a vector into the plane of the paper, while a filled in circle, •, represents a vector pointing out of the plane of the paper towards the reader), as well as the direction of the power flow represented by Poynting's vector P (i.e., E×H) on both sides of the forward loop FL. When the wave represented by the vector diagram 24 hits the plate with high permeability and no conductivity, the sign of magnetic vector H is reversed, but the electric vector E remains unchanged (as shown in the vector diagram 26). The reflected wave 26 now adds to the outwardly radiated wave 22 from the forward loop.

Figure 6:
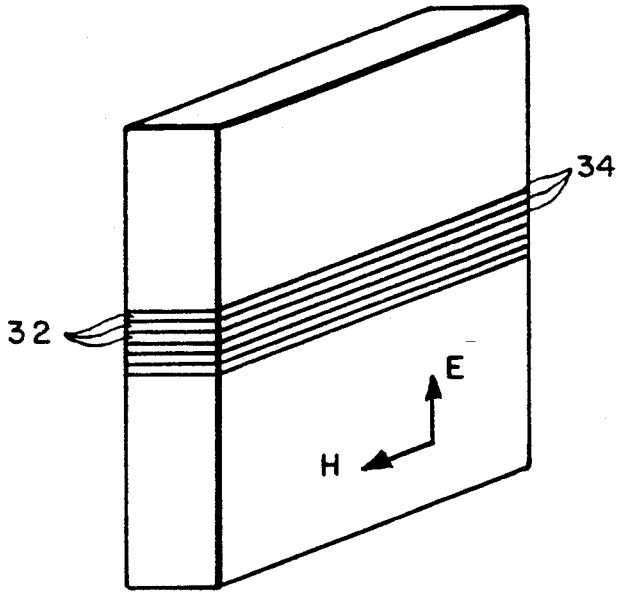
FIG. 6 is a diagrammatic illustration showing a material with high permeability in the direction of the H field and low conductivity in the direction of the E field.

Examples of materials with high permeability are soft steel and advanced products available under names like Permalloy and $\mu$-metal. Their relative permeability is typically between 10000 and 20000, which is acceptable, but their conductivity is that of metals, on the order of $10^6$A/Vm. FIG. 6 shows a means for reducing the conductivity in the direction of the electric field strength. Thin sheets 32 of $\mu$-metal are stacked with thin sheets of paper 34, or lacquer, which are used as insulation, between the layers. The electric field strength E cannot drive a current through the insulating material between the sheets of $\mu$-metal. This is the same principle that is used in making iron cores for transformers.

Making the sheets of $\mu$-metal in FIG. 6 very thin, results in a material with large permeability in the direction of H and essentially no conductivity in the direction of E. This is a reflective type material. Making the sheets of $\mu$-metal thicker or using a poor insulator between the sheets, results in a material with large permeability in the direction of the H vector in FIG. 6 and low conductivity in the direction of the E vector. This is an absorbing material since part or all of the wave penetrates the material and is absorbed by ohmic losses. If the stack of $\mu$-metal is not separated by insulators at all, it becomes a material with high permeability and high conductivity in every direction. For all practical purposes, such material will act as a metallic plate whose permeability is of little consequence. So, instead of reversing the polarity of the magnetic field strength H, it reverses the polarity of the electric field strength E. Consequently, the reflected wave tends to cancel the radiated wave.

Figure 7:
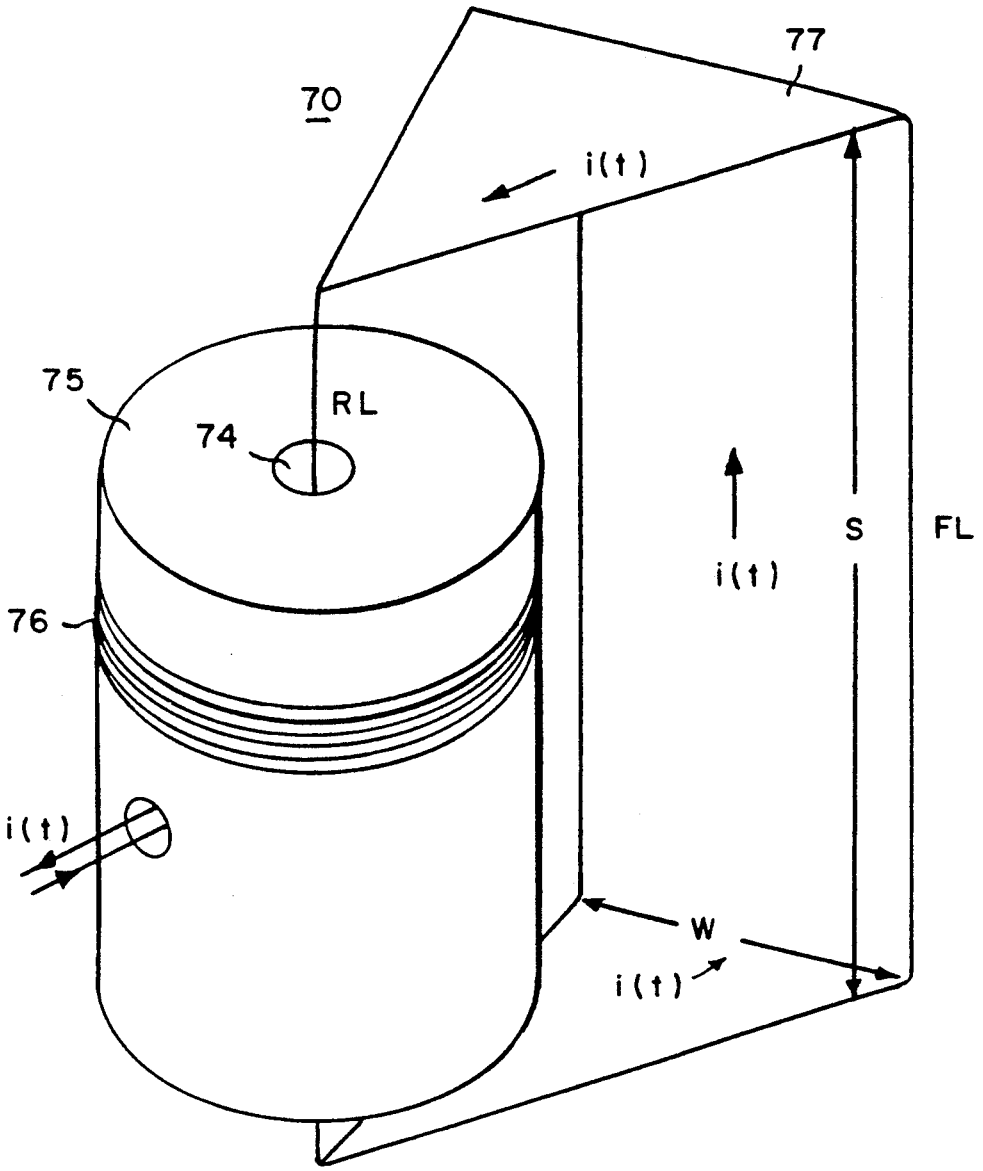
FIG. 7 is a diagramatic illustration of an improved radiator according to FIG. 4, that uses the material of FIG. 6 to separate the return loop (RL) from the forward loop (FL)

A high current antenna design of the type shown in FIG. 4, that uses the material of FIG. 6, is shown in FIG. 7. The return loop RL is confined to cover a small surface, and, is surrounded by a shield of high permeability, low conductivity material 75 which is composed of laminations of circular sheets of $\mu$-metal, Permalloy material, etc. which are electrically insulated from each other by sheets of paper, lacquer, or other insulating material. A few exemplary laminations are shown at 76. Though shield 75 is illustrated in cylindrical shape, other shapes may be employed; in general, these shapes will include a variety of three-dimensional solid configurations, all having a bore 74 through which the return loop may pass. This shield acts as a reflector for low frequency electromagnetic waves and thereby allows the construction of a greatly improved radiator for high currents. It is compact, has a small value of s, can be excited with very large current pulses, and is a more efficient radiator than the prior art radiator described in U.S. Pat. No. 4,506,267.

Figure 8:
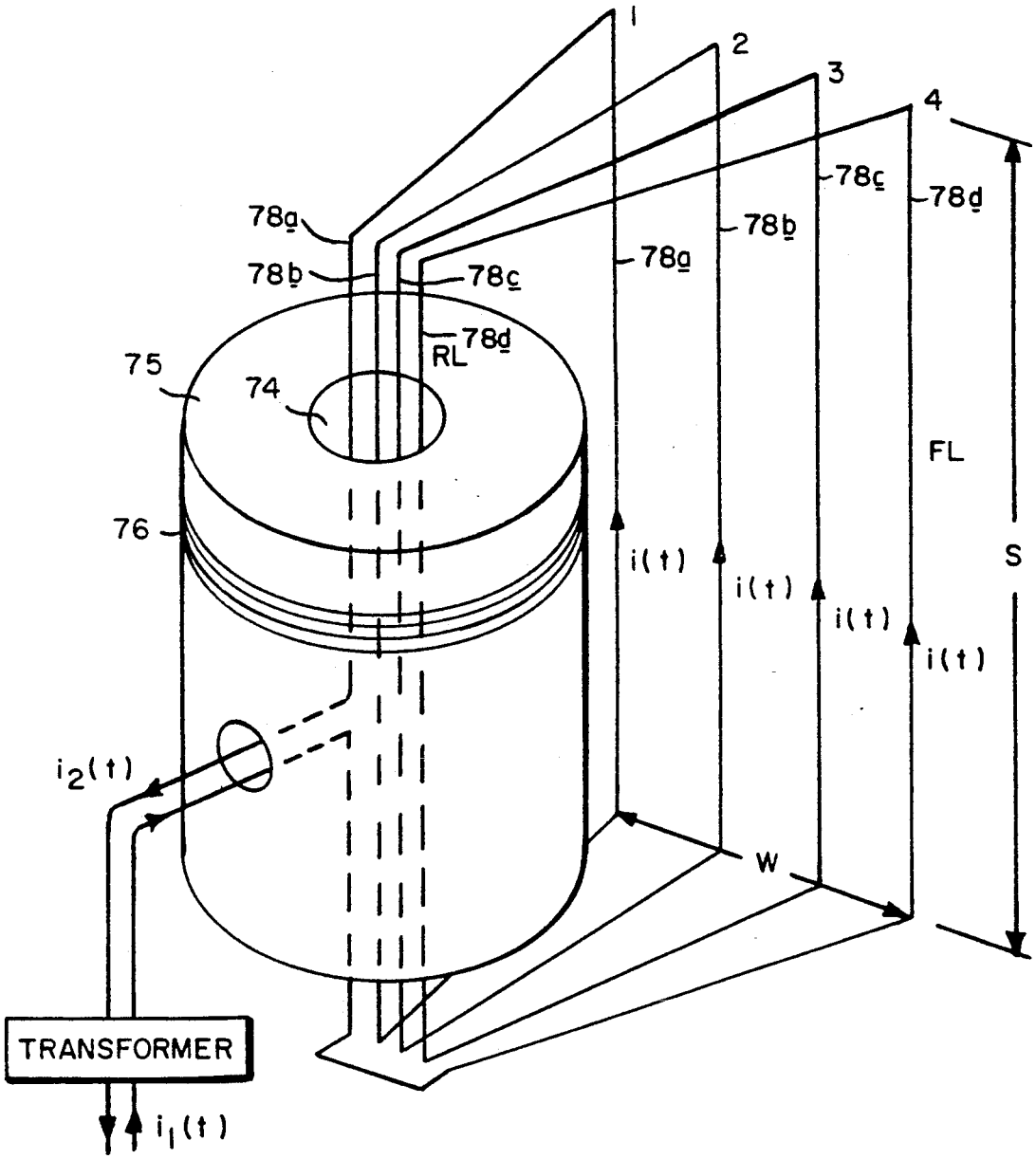
FIG. 8 is a diagramatic illustration of the radiator of FIG. 7 further improved by replacing the one current loop by four series wound loops covering a predetermined surface area.

However, an improvement of the design of FIG. 7 is still needed to avoid having to use a current driver that can handle hundreds of kiloAmperes. FIG. 8 illustrates such an embodiment in which the one current loop 77 of FIG. 7 is replaced by n=4 series wound current loops **78*a*–78*d* that cover a large surface area. The plate 77 of FIG. 7 becomes a series of wires 78*a*–78*d* coverinq the same surface area sxW, while the return loops 79*a*–79*d*** are crowded together into a bundle covering a relatively small surface area. Only four such loops are shown in order to simplify the drawing, but in reality there could be hundreds or even thousands of loops. The forward loops of the n wires of FIG. 8 can be geometrically arranged to cover a large area, just as the plate of FIG. 7 did. It is evident that the current ni(t) will be flowing in the large surface area "plate", implemented by n wires, if a current i(t) is delivered from the current driver.

To obtain an understanding of the practical limitations of this design, assume that s equals 1 m in FIG. 8. If a loop is approximately square, then 4 m of wire are required per loop. Let a pulse with duration T=10 ms be radiated. Light travels 3000 km in 10 ms. 40000 m of this value is about 1.33 percent. Hence, 10000 wire loops each 4 m can be used before the delay between the beginning and the end of the wire becomes significant. If n=10,000, then a drive current of 100 A will produce a radiated current of $10^6$A=IMA . If this is not enough, more wires in parallel can be used, for example, 10, to obtain I=10 MA. If more current is needed, a transformer can be used since the driving voltage is still quite small. However, at this time, the practical limit of the driving current, without resorting to a transformer, is not a current of 100 A, but 10 kA, since such currents are switched in electric locomotives, the chemical industry, and in rail guns. Hence, the technological limit for the radiated current is presently around I=1 GA, which is well beyond any envisioned application.

For an airborne radiator a length s=1 m and a current I=100 MA appear to be the practical limits. To determine the power these parameters represent, E×H is integrated over the surface of a half sphere at a distance r and we note that $$P(t) = \tfrac{1}{2} Z_o \left(\frac{sI}{4c}\right)^2 \left(\frac{df}{dt}\right)^2 \qquad \text{(Eq. 7)}$$

If T=10 ms; s=1 m; I=10 sA and df/dt=100 per sec, then the present limit for the power of an airborne radiator is:

$$P_{max} = \frac{377}{2}\left(\frac{1 \times 10^8}{4 \times 3 \times 10^8}\right)^2 \times (100)^2 = 1.3 \times 10^4 \text{ W} = 13 \text{ kW} \qquad \text{(Eq. 8)}$$

A ship could easily produce ten times this power.

To obtain some idea about the driving voltage required, consider the radiation of the power $P_t$=1 W with an antenna of length S=1 m and I=490 kA. Substitution into Eq. (6) yields:

$$v = P_t/I = 1/4.9 \times 10^5 = 2.0 \times 10^{-6}\ V = 2.0\ \mu V \qquad \text{(Eq. 9)}$$

Note that this is only the voltage required to radiate the power of 1 W. An additional voltage is required to build up the near field, which energy is not radiated but flows back into the radiator at the end of the pulse. The ohmic resistance of the radiator will also require a significant voltage. Furthermore, the reduction of the antenna current of 490 kA to the much lower driver current implies a corresponding increase of the driving voltage.

A few words should be said about the cross-section of the high permeability cylindrical shield 75 around the return loops in FIGS. 7 and 8. This cross section must be large enough to prevent saturation and thus a decrease of the permeability. The theory for the determination of the cross-section is presented in books on transformers. It depends on the radiated power, the pulse duration, and the properties of the high-permeability material. Since books on transformers use frequency f instead of pulse duration T, f=½T should be used as a first approximation. Hence, for T=10 ms, f=50 Hz. A transformer for 50 or 60 Hz handling 1 kW of power has a cross-section of the iron core for the magnetic flux on the order of 10 $cm^2 = 10^{-3} m^2$. If s in FIG. 8 equals 1 m, the required cross-section is $10^{-3}$ m/1=0.001 m=1 mm. The diameter of the cylinder is twice this value plus the diameter of the hole for the return loop RL. Mechanical considerations will be more important than magnetic saturation for the design of the high permeability cylinder.

Figure 9:
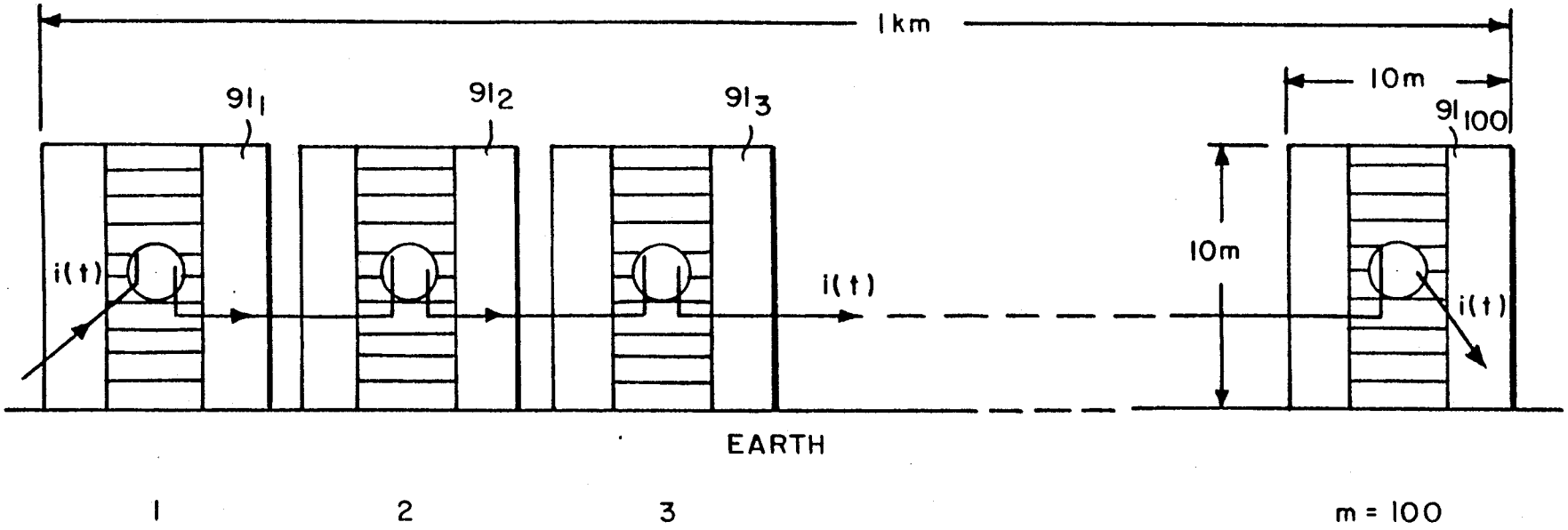
FIG. 9 is an illustration of a radiator built by placing 100 radiators, according to FIG. 7, side by side to produce a radiated power equal to that of one radiator with length s Km.

For a land based radiator, the length s can be increased to lkm or even 10 km without actually building a radiator according to FIG. 8. Let s in FIG. 7 be 10 m, which is quite practical for a land based antenna. Instead of increasing s to 1 km by using the technique of FIG. 8, 100 radiators of the type shown in FIG. 7 can be placed side by side, as shown in FIG. 9. The result is an array 10 m high and 1 km long that looks like a wall. By driving current not in parallel, but in series, through the 100 radiators, no increase in the driving current is required, but the driving voltage must be increased by a factor $100^2 = 10^4$, which is a decisive advantage. The radiated power increases by a factor $10^4$. Several (e.g., 10) such arrays can also be built, not necessarily close together but, for example, spread over an area of 30 km × 30 km=900 $km^2$. A time of 100 μs is then required to make all radiators interact. After this time the radiated power will have increased by a factor $10^2$.

Consider the power limitations for a land based radiator. Let s be 10 m for one radiator. A line of 100 such radiators Substitution for S=1 m in Eg. 6 produces:

$$P_{max} = \frac{377}{2}\ \frac{10^4 \times 10^2}{4 \times 3 \times 10^8} \times 100^2 = 1.3 \times 10^{12} \text{ W} = 1.3 \text{ TW} \qquad \text{(Eq. 10)}$$

Hence the radiable power is no longer a limitation for land-based radiators of slowly varying waves.

As this invention may be embodied in several forms without departing from the spirit of the essential characteristics thereof, the embodiments shown are therefore illustrative and presented by way of example only. The scope of the invention is defined by the appended claims rather than by the description preceding them. Accordingly, the invention is defined not by the illustrative examples, but only by the following claims and their equivalents.

What is claimed is:

1. A non-resonant antenna for non-sinusoidal very low frequency (vlf) electromagnetic waves comprising relatively long pulses on the order of 10 ms in duration, comprising:

first electrically conductive means formed to cover a first surface area having a predetermined length;

second electrically conductive means formed to cover a second surface area which is substantially smaller than the first surface area, electrically connected in series with the first electrically conductive means having the predetermined length; and shield means disposed substantially between the first electrically conductive means and the second electrically conductive means, including a pair of apertures through which said first conductive means and said second conductive means are serially connected so that the current in the first conductive means is equal to the current in the second conductive means, and wherein said shield means electromagnetically separates said first conductive means from said second conductive means, so that any electromagnetic energy radiated or received by the first conductive means is not radiated or received by the second conductive means, shield means having a first surface facing the first electrically conductive means and being made substantially of electromagnetically reflective material for reflecting, back towards the first conductive means, the electromagnetic energy incident on it from the first electrically conductive means.

2. An antenna according to claim 1 wherein said first surface of said shield means is an electromagnetically reflective material having a high permeability to said vlf pulses of relatively long duration in a first direction and substantially no conductivity to said pulses in a second direction that is perpendicular to said first direction.

3. An antenna according to claim 2 wherein:

said first direction is parallel to the magnetic field vector H of the electromagnetic wave produced by said first electrically conductive means; and said second direction is parallel to the electric field vector E in the electromagnetic wave produced by said first electrically conductive means.

4. An antenna according to claim 2 wherein the first surface of the shield means comprises:

laminations of high permeability material;

at least one lamination of an electrically insulating material; and the laminations of high permeability material being stacked in parallel to each other with a lamination of said electrically insulating material between them.

5. An antenna according to claim 1 further comprising:

electromagnetically absorbing means facing the second electrically conductive means for absorbing a substantial portion of the energy radiated by the second electrically conductive means such that substantially no electromagnetic energy is reflected from the absorbing means toward the second conductive means.

6. An antenna according to claim 1 wherein:

said first electrically conductive means includes an electrically conductive plate with a large surface area; and said second electrically conductive means includes electrically conducting wire.

7. An antenna according to claim 1 wherein:

said first conductive means and said second conductive means are comprised of a set of N electrically conducting wires wound in series, wherein said first conductive means is and disposed over said first surface area on a first side of said shield means; and said second electrically conductive means is disposed on a second side of said shield means, and disposed over said second surface area.

8. The antenna of claim 1 wherein the shield means substantially encircles the second electrically conductive means.

9. The antenna of claim 8 wherein the second electrically conductive means is a set of wires and the shield means is a three-dimensional solid shape with the set of wires passing through the apertures therein.

10. The antenna of claim 9 wherein the three-dimensional solid shape is cylindrical.

11. An antenna according to claim 1 wherein the first and second electrically conductive means are comprised of k conductors electrically connected in series, each carrying the same current, so that the current carrying capacity of the antenna is k times the current in each conductor.

12. An array of M antennas, each constructed according to claim 1 wherein the M antennas are electrically connected in series, and physically arranged to form one long antenna.

13. An antenna according to claim 1 further including a step down transformer, a first current being supplied to an input of the step down transformer, a second current, produced at the output of the step down transformer, being connected to drive the first conductive means, whereby the first current is smaller than the second current.

14. A non-resonant antenna for non-sinusoidal very low frequency (vlf) electromagnetic waves comprising relatively long pulses on the other of 10 ms in duration, comprising:

first electrically conductive means formed to cover a first surface area having a predetermined length;

second electrically conductive means formed to cover a second surface area which is substantially smaller than the first surface area, electrically connected in series with the first electrically conductive means having the predetermined length; and shield means disposed substantially between the first electrically conductive means and the second electrically conductive means, including a pair of apertures through which said first conductive means and said second conductive means are serially connected so that the current in the first conductive means is equal to the current in the second conductive means, and wherein said shield means electromagnetically separates said first conductive means from said second conductive means so that any electromagnetic energy radiated or received by the first conductive means is not also radiated or received by the second conductive means, said shield means having a first surface facing the second electrically conductive means and an opposite second surface facing the first electrically conductive means, wherein the first shield surface is made at least partly of electromagnetically absorptive material for absorbing a substantial portion of the electromagnetic energy incident on it from the second electrically conductive means, such that substantially no electromagnetic energy is reflected from the first shield surface toward the second conductive means.

15. An antenna according to claim 14 wherein said first surface of said shield means is an electromagnetically absorptive material having a high permeability to said vlf pulses of relatively long duration in a first direction and a non-zero conductivity to said pulses in a second direction that is perpendicular to said first direction.

16. An antenna according to claim 15 wherein:

said first direction is parallel to the magnetic field vector H of the electromagnetic wave produced by said second electrically conductive means; and said second direction is parallel to the electric field vector E of the electromagnetic wave produced by said second electrically conductive means.

17. An antenna according to claim 15 wherein the first surface of the shield means comprises:

first laminations of high permeability material that are electrically conductive; and second laminations of known electrical conductivity; wherein said first laminations are stacked parallel to each other with at least one second lamination between each pair of first laminations.

18. An antenna according to claim 14 wherein:

said first electrically conductive means includes an electrically conductive plate with a large surface area; and said second electrically conductive means includes an electrically conducting wire.

19. An antenna according to claim 14 wherein:

said first conductive means and said second conductive means are comprised of a set of N electrically conducting wires wound in series, wherein said first conductive means is disposed over said first surface area on a first side of said shield means; and said second electrically conductive means is disposed on a second side of said shield means, and disposed over said second surface area.

20. The antenna of claim 14 wherein the shield means substantially encircles the second electrically conductive means.

21. The antenna of claim 20 wherein the second electrically conductive means is a set of wires and the shield means is a three-dimensionally solid shape with the set of wires passing through the apertures therein.

22. The antenna of claim 21 wherein the three-dimensional solid shape is cylindrical.

23. A method which includes the steps of:

a) providing an antenna with, connected in series through a pair of apertures in a shield, 1) a forward loop that covers a large area surrounding at least a section of the shield that electromagnetically reflects signals incident upon it back towards the forward loop, and 2) a return loop that is surrounded by the shield wherein a second section of the shield electromagnetically absorbs signals, radiated by the return loop;

b) driving a high current through the forward and return loops for radiating large relative bandwidth electromagnetic energy; and c) sensing current in both the forward and return loops when receiving electromagnetic energy in the forward loop.

24. A non-resonant antenna for radiating and receiving non-sinusoidal, very low frequency electromagnetic waves comprising:

an electromagnetic shield including a pair of apertures therein;

a large number of electrically conductive means for carrying large current, connected in series through said apertures, and disposed so as to form:

a) a forward loop that covers a first surface area on a first side of said electromagnetic shield, and b) a return loop that covers a second surface area that is substantially smaller than the first surface, and on a second side of said electromagnetic shield opposite the first side of said electromagnetic shield;

wherein the first side of said shield reflects the electromagnetic energy radiated by or received by the forward loop.

* * * * *

UNITED STATES PATENT AND TRADEMARK OFFICE

CERTIFICATE OF CORRECTION

PATENT NO. : 5,307,081

DATED : April 26, 1994

INVENTOR(S) : Henning F. Harmuth

It is certified that error appears in the above-indentified patent and that said Letters Patent is hereby corrected as shown below:

On the title page, item [75] Inventor: "Henny F. Harmuth" should read --Henning F. Harmuth--.

Signed and Sealed this

Nineteenth Day of July, 1994

Bruce Lehman

*Attest:*

BRUCE LEHMAN

*Attesting Officer*

*Commissioner of Patents and Trademarks*